US010135206B2

(12) United States Patent
Qiao et al.

(10) Patent No.: US 10,135,206 B2
(45) Date of Patent: Nov. 20, 2018

(54) ELECTRICAL CONNECTOR HAVING A BASE WITH AN INVERTED T-SHAPED CHANNEL

(71) Applicant: 3M INNOVATIVE PROPERTIES COMPANY, St. Paul, MN (US)

(72) Inventors: YunLong Qiao, Singapore (SG); Rao L. Vittapalli, Singapore (SG); Saujit Bandhu, Singapore (SG); Vincent Tan, Singapore (SG); Kok Hoe Lee, Singapore (SG); Chin Hua Lim, Singapore (SG)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 15/312,283

(22) PCT Filed: Jun. 1, 2015

(86) PCT No.: PCT/US2015/033465

§ 371 (c)(1),
(2) Date: Nov. 18, 2016

(87) PCT Pub. No.: WO2015/191317

PCT Pub. Date: Dec. 17, 2015

(65) Prior Publication Data

US 2017/0085042 A1 Mar. 23, 2017

Related U.S. Application Data

(60) Provisional application No. 62/011,754, filed on Jun. 13, 2014.

(51) Int. Cl.
*H01R 24/00* (2011.01)
*H01R 33/00* (2006.01)
(Continued)

(52) U.S. Cl.
CPC ..... *H01R 24/62* (2013.01); *H01R 12/57* (2013.01); *H01R 12/721* (2013.01);
(Continued)

(58) Field of Classification Search
CPC .... H01R 12/57; H01R 12/721; H01R 12/727; H01R 12/732; H01R 12/75; H01R 13/2442; H01R 23/02; H01R 24/60; H01R 24/62
(Continued)

(56) References Cited

U.S. PATENT DOCUMENTS 6,743,060 B2 * 6/2004 Wu ..... H01R 13/41 439/660
7,955,138 B1 * 6/2011 Zhu ..... H01R 13/42 439/660
(Continued)

FOREIGN PATENT DOCUMENTS

| | | |
|---|---|---|
| CN | 203166137 | 8/2013 |
| WO | WO 2010-144756 | 12/2010 |
| WO | WO 2015-017150 | 2/2015 |

OTHER PUBLICATIONS

International Search Report for PCT International Application No. PCT/US2015/033465, dated Dec. 11, 2015, 4 pages.

*Primary Examiner* — Chandrika Prasad
(74) *Attorney, Agent, or Firm* — Jonathan L. Tolstedt

(57) ABSTRACT

Electrical connectors are described. More particularly, electrical connectors including a plurality of contacts are described. Both connector plugs and sockets are described. Electrical connectors that are suitable for mounting on a printed circuit board and electrical connectors that include a printed circuit board are described.

3 Claims, 14 Drawing Sheets

(51) Int. Cl.

| | |
|---|---|
| ***H01R 24/62*** | (2011.01) |
| ***H01R 24/60*** | (2011.01) |
| ***H01R 12/57*** | (2011.01) |
| ***H01R 12/72*** | (2011.01) |
| ***H01R 12/73*** | (2011.01) |
| ***H01R 13/24*** | (2006.01) |
| *H01R 107/00* | (2006.01) |

(52) U.S. Cl.
CPC ..... *H01R 12/727* (2013.01); *H01R 12/732* (2013.01); *H01R 13/2442* (2013.01); *H01R 24/60* (2013.01); *H01R 2107/00* (2013.01)

(58) Field of Classification Search
USPC ..... 439/629, 660, 924.1
See application file for complete search history.

(56) References Cited

U.S. PATENT DOCUMENTS

| | | | | |
|---|---|---|---|---|
| 2003/0003809 | A1* | 1/2003 | Maiers | G11B 25/043 439/629 |
| 2011/0045705 | A1* | 2/2011 | Zhu | H01R 13/41 439/660 |
| 2011/0104914 | A1* | 5/2011 | Zhu | H01R 12/707 439/83 |
| 2015/0144383 | A1* | 5/2015 | Goodwin | H05K 1/0284 174/255 |

* cited by examiner

ELECTRICAL CONNECTOR HAVING A BASE WITH AN INVERTED T-SHAPED CHANNEL

BACKGROUND

Electrical connectors are often used to mate signal-carrying cables with input or output ports. Electrical connectors may be designed or configured to be easily attachable or detachable.

SUMMARY

In one aspect, the present disclosure relates to an elongated electrical connector for mounting on a printed circuit board and mating with a mating connector along a mating direction, where the connector includes an elongated base extending along a longitudinal direction perpendicular to the mating direction, first and second end walls extending forwardly along the mating direction from opposite longitudinal ends of the base, coplanar first and second tongues extending forwardly along the mating direction from the base and defining a gap therebetween, a plurality of spaced apart parallel passageways on a top surface of the first and second tongues oriented along the mating direction, each passageway extending through the base, a plurality of spaced apart inverted T-shaped through channels defined in the base, each inverted T-shaped through channel comprising a wider bottom member aligned with a corresponding passageway and a narrower vertical member, the bottom member and the passageway, in combination, defining a retaining cavity in the base, and a plurality of contacts. Each contact includes a contact member disposed in a corresponding passageway for making contact with a corresponding contact of a mating connector; a retaining member extending from the contact member and secured in a corresponding retaining cavity, the retaining member being exposed to the narrower vertical member of the through channel corresponding to the retaining cavity, and a mounting member extending from the retaining member beyond a back surface of the base for mounting on a printed circuit board. In some embodiments, each of the first and second tongues has a side wall separating the tongue from the gap. In some embodiments, the elongated base and each of the first and second end walls define an opening between the base and the end wall extending from a front surface to a back surface of the base.

In another aspect, the present disclosure relates to an elongated electrical connector for mounting on a printed circuit board and mating with a mating connector along a mating direction, where the connector includes an elongated base extending along a longitudinal direction perpendicular to the mating direction, first and second end walls extending forwardly along the mating direction from opposite longitudinal ends of the base, coplanar first and second tongues extending forwardly along the mating direction from the base and defining a gap therebetween, a plurality of spaced apart contacts oriented along the mating direction, each contact disposed in a corresponding passageway formed on a major surface of the first and second tongues, and a plurality of spaced apart parallel ribs oriented along the longitudinal direction formed in a portion of the elongated base corresponding to the gap. In some embodiments, each rib in the plurality of spaced apart parallel ribs is confined to the portion of the elongated base corresponding to the gap. In some embodiments, the plurality of spaced apart parallel ribs define a plurality of spaced part parallel channels formed in the portion of the elongated base corresponding to the gap, each channel extending only partially along the mating direction into the elongated base.

In some embodiments, the electrical connector further includes a L-shaped support extending rearwardly along the mating direction from a back surface of the elongated base, the support having a longer arm oriented along the mating direction and a shorter arm oriented along a transverse direction perpendicular to the longitudinal and mating directions, such that when the elongated electrical connector is mounted on a printed circuit board, the longer arm is parallel to and spaced apart from the printed circuit board and the shorter arm rests on the printed circuit board. In some embodiments, the longer arm defines a channel formed on a bottom major surface of the longer arm. In some embodiments, the longer arm is connected to the shorter arm via a substantially curved joining portion. In some embodiments, the longer arm is connected to the shorter arm via a substantially straight joining portion.

In yet another aspect, the present disclosure relates to an elongated electrical connector for mounting on a printed circuit board and mating with a mating connector along a mating direction, the connector including an elongated base extending along a longitudinal direction perpendicular to the mating direction, first and second end walls extending forwardly along the mating direction from opposite longitudinal ends of the base, coplanar first and second tongues extending forwardly along the mating direction from the base and defining a gap therebetween, a plurality of spaced apart contacts oriented along the mating direction, each contact disposed in a corresponding passageway. Each contact includes a front member extending along the mating direction and disposed in a corresponding passageway formed on a top major surface of the first and second tongues for making contact with a corresponding contact of a mating connector, a rear member parallel to the front member and extending away from the elongated base for mounting on a printed circuit board, and a middle member having a generally inverted U-shape joining the front and rear members. The middle member includes a first leg portion extending upwardly from the front member, a base portion extending from the first leg portion along the mating direction and away from the elongated base, and a second leg portion extending downwardly from the base portion and joining the base portion to the rear member, the front member being below the rear member. In some embodiments the electrical connector further includes a plurality of spaced apart parallel co-planar protrusions extending rearwardly from a backside of the elongated base, at least a portion of the middle member of each contact being disposed between two neighboring protrusions. In some embodiments, the protrusions are chamfered. In some embodiments, the front member of the spaced apart contacts extends vertically beyond a top surface of either first or second tongues.

In another aspect, the present disclosure relates to an electrical connector. The electrical connector includes a unitary housing elongated along a horizontal direction perpendicular to a mating direction of the connector—the unitary housing comprising an elongated base, opposing end walls and opposing top and bottom walls extending forwardly from the base along the mating direction and defining first and second L-shaped central slots therebetween separated by a middle wall, each L-shaped central slot comprising a longer horizontal slot portion and a shorter vertical slot portion adjacent the middle wall—a plurality of spaced apart contacts oriented along the mating direction, where each contact includes a flexible contact member disposed in a corresponding passageway formed in a top wall of the longer horizontal slot portions of the first and second central slots for making contact with a corresponding contact of a mating connector, a retaining member extending from the flexible contact member and secured in the top wall, and a mounting member extending downwardly from the retaining member along a back surface of the base for mounting on a printed circuit board, and the electrical connector further includes a plurality of spaced apart parallel co-planar protrusions extending rearwardly from a bottom of the backside of the elongated base, a portion of the mounting member of each contact being disposed between two neighboring protrusions. In some embodiments, the electrical connector further includes at least one engaging protrusion protruding upwardly from the bottom wall into each of the first and second central slots for engaging a corresponding recess defined in a bottom surface of a tongue of a mating connector. In some embodiments, the engaging protrusion has an asymmetric shape. In some embodiments, the engaging protrusion has a symmetric shape. In some embodiments, the flexible contact member of the contacts extends at least partially downward from the retaining member. In some embodiments, the flexible contact member of the contacts has a generally V-shape.

In yet another aspect, the present disclosure relates to an elongated electrical connector for mounting on a printed circuit board and mating with a mating connector along a mating direction, the connector including an elongated base extending along a longitudinal direction perpendicular to the mating direction, first and second end walls extending forwardly along the mating direction from opposite longitudinal ends of the base, a bottom tongue extending forwardly along the mating direction from the base and disposed between and spaced apart from the first and second end walls, the bottom tongue having a uniform thickness along its length along the longitudinal direction and comprising first and second bottom tongue portions separated by a third bottom tongue portion, a top tongue having a front portion extending forwardly along the mating direction from the base and a rear portion extending rearwardly along the mating direction from the base, the top tongue disposed between and spaced apart from the first and second end walls, the top tongue having a uniform thickness along its length along the longitudinal direction and being spaced apart from the bottom tongue along a thickness direction perpendicular to the mating and longitudinal directions, a bottom surface of the front portion of the top tongue facing a top face of the third bottom tongue portion, a plurality of spaced apart first contacts disposed on a top surface of the first bottom tongue portion, a plurality of spaced apart second contacts disposed on a top surface of the second bottom tongue portion, a plurality of spaced apart third contacts disposed on a bottom surface of the bottom tongue; and a plurality of spaced apart fourth contacts. Each fourth contact includes a front member extending along the mating direction and disposed in a corresponding passageway formed on a top surface of the front portion of the top tongue for making contact with a corresponding contact of a mating connector, a rear member extending from rear portion of the top tongue for mounting on a printed circuit board, and a middle member joining the front and rear members and being embedded in the rear portion of the top tongue. In some embodiments, the rear portion of the top tongue includes a plurality of spaced apart co-planar protrusions, the protrusions disposed such that the rear members of the fourth contacts are disposed between two neighboring protrusions.

In yet another aspect, the present disclosure relates to an elongated electrical connector for mating with a mating connector along a mating direction, the connector including a circuit board including a plurality of spaced apart first contact pads disposed in a first region near a front edge of the circuit board, a plurality of spaced apart second contact pads disposed in a second region near the front edge of the circuit board, the first and second regions defining a third region therebetween near the front edge of the circuit board, where the first, second and third regions forming a bottom mating tongue of the connector, each first and second contact pad configured to make contact with a corresponding contact of a mating connector, a plurality of spaced apart third contact pads disposed in a fourth region between the first and second regions and behind the third region, an elongated base extending along a longitudinal direction perpendicular to the mating direction attached to the circuit board, such that the first and second pluralities of contact pads are on a front side of the elongated base and the third plurality of contact pads is on a rear side of the elongated base, a top mating tongue extending forwardly along the mating direction from the elongated base between the first and second end walls, the top mating tongue being disposed in the third region between the first and second regions, and a plurality of spaced apart contacts. Each contact includes a front member extending along the mating direction and disposed in a corresponding passageway formed on a top surface of the top mating tongue for making contact with a corresponding contact of a mating connector and a rear member extending rearwardly from the elongated base and making contact with a corresponding third contact pad. In some embodiments, the at least a portion of the plurality spaced apart contacts is embedded within the elongated base. In some embodiments, substantially all of the rear members of the plurality of spaced apart contacts are embedded within the elongated base. In some embodiments, the third region has no contact pads.

In another aspect, the present disclosure relates to a connector assembly. The connector assembly includes an elongated electrical connector for mounting on a printed circuit board and mating with a mating connector along a mating direction, the connector including an elongated base extending along a longitudinal direction perpendicular to the mating direction, first and second end walls extending forwardly along the mating direction from opposite longitudinal ends of the base, a middle wall extending forwardly along the mating direction from a middle of the base, the middle wall disposed between the first and second end walls, a first tongue extending forwardly along the mating direction from the base and disposed between and spaced apart from the first end wall and the middle wall, the first tongue having a uniform thickness along its length along the longitudinal direction, a second tongue extending forwardly along the mating direction from the base and disposed between and spaced apart from the second end wall and the middle wall, the second tongue comprising thinner first and second tongue portions separated by a thicker third tongue portion, a plurality of spaced apart first contacts disposed on a top surface of the first tongue, a plurality of spaced apart second contacts disposed on a top surface of the first tongue portion of the second tongue, a plurality of spaced apart third contacts disposed on a top surface of the second tongue portion of the second tongue, and a cable assembly. The cable assembly includes a housing surrounding the first tongue, a plurality of spaced apart fourth contacts disposed in the housing—each fourth contact having a generally U-shape and including a first leg portion extending horizontally and contacting a corresponding first contact, a second leg portion extending horizontally above the first leg portion, and a base portion joining the first and second leg portions—and a plurality of conductive wires, each wire contacting a corresponding second leg portion. In some embodiments, the cable assembly further comprises an overmold encapsulating at least contact points between corresponding wires and second leg portions. In some embodiments, the overmold includes a thermally curable material. In some embodiments, the overmold includes a ultraviolet curable material. In some embodiments, the first leg portion includes a proximate end proximate the base portion and a distal end not proximate the base portion, and a lowest point of the first leg portion is substantially centered between the proximate end and the distal end. In some embodiments, the plurality of conductive wires of the cable assembly are shared with another cable assembly.

DETAILED DESCRIPTION

Figure 1:
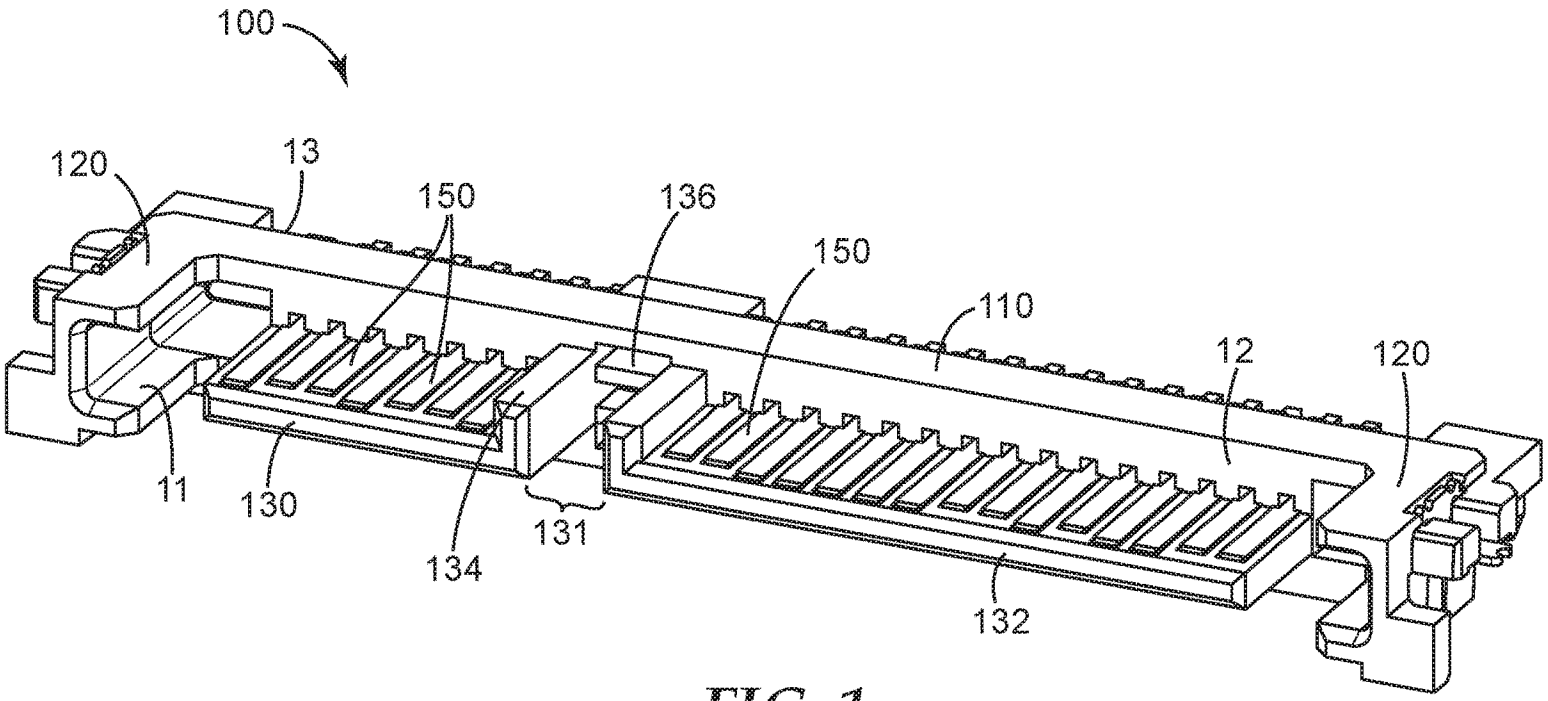
FIG. 1 is a front perspective view of a connector plug.

FIG. 1 is a front perspective view of a connector plug. Connector plug 100 includes elongated base 110, end walls 120, first tongue 130, gap 131 having rib 136, and second tongue 132, side walls 134, and contact members 150.

Connector plug 100, and more specifically, elongated base 110, end walls 120, first tongue 130, second tongue 132, rib 136, and side walls 134 may have any suitable dimensions and may be formed from any suitable material. In some embodiments, connector plug 100 and its constituent components may be all made from the same material. In some embodiments, the non-conductive components of the connector plug may be made out of an injection moldable material, such as plastic. In some embodiments, the connector plug may be formed at least in part through a rapid prototyping process, such as additive 3D printing. The specific choice of plastic or other material may depend on the desired application, and may take into account moldability, flexibility, durability, heat and melt resistance, resistivity, impedance, thermal expansion, density, weight, or any other electrical or physical characteristic.

Elongated base 110 extends in a longitudinal direction, perpendicular to a mating direction, and may substantially define a width of connector plug 100. In some embodiments, elongated base 110 may include one or more holes for mounting upon a printed circuit board or other surface. Elongated base 110 may include suitable features to reinforce points where it may be susceptible to physical failure. Elongated base 110 may be any suitable shape, potentially including one or more curved sections or features.

End walls 120 may be a unitary part of elongated base 110 or the end walls may be formed from a separate material or may be attached or adhered to elongated base 110 after forming. End walls 120 may provide physical stability or bend and warp resistance or may facilitate the mating of connector plug 100 with a corresponding socket or help secure and stabilize the plug and socket once mated. Elongated base 110 and each of first and second end walls 120 define an opening 11 between the base and the end wall extending from a front surface 12 to a back surface 13 of the base.

Between end walls 120 are first tongue 130 and second tongue 132, with gap 131 between the two tongues and delimited by side walls 134. First tongue 130 and second tongue 132 may be coplanar and extend forwardly along a mating direction from the elongated base. In some embodiments, first tongue 130 and second tongue 132 may be the same size or symmetrically arranged. In some embodiments, they may be asymmetrically arranged and sized. In some embodiments, the respective sizes of first tongue 130 and second tongue 132 depend on the number or sizes of contacts desired or required depending on the connector type or configuration. Side walls 134 separate first tongue 130 and second tongue 132 both from each other and also from the intermediate gap 131.

Side walls 134 may be any suitable height and may extend along some, most, or all of the height of elongated base 110 or connector plug 100 as a whole. Side walls 134 may have any suitable thickness and may have a beveled or chamfered end. The chamfering may allow for easier insertion into a corresponding socket. For many of the features described herein, the dimensions configuration of parts may largely be based on standardized connector shapes, which may limit the degree of design flexibility possible with respect to certain aspects of the connector plug. Such design requirements, however, should be well known or easily accessible to those skilled in the art. Within gap 131 may be one or more of rib 136. Rib 136 extends forwardly in a mating direction from elongated base 110 and may provide reinforcement of the otherwise potentially structurally weaker gap 131. Any number of parallel ribs may be used, and they may extend across all or some of gap 131. In some embodiments, some of the ribs may extend different lengths from elongated base 110.

A plurality of contacts are disposed on the tongues of elongated base 110. More specifically, contact members 150 which are designed or configured to make contact with a corresponding contact of a mating connector are disposed within passageways, which are described and illustrated in more detail in conjunction with FIG. 2. Contact members 150 may be flattened, rounded, or coined in order to better facilitate contact with corresponding contacts of mating connectors. Contact members 150, as well as all of the contacts, may be any suitable material, including highly conductive materials such as copper, gold, silver, copper-plated steel, or the like may be used. Electrical characteristics and physical characteristics (such as malleability) may be considered in choosing appropriate contact materials.

Figure 2:
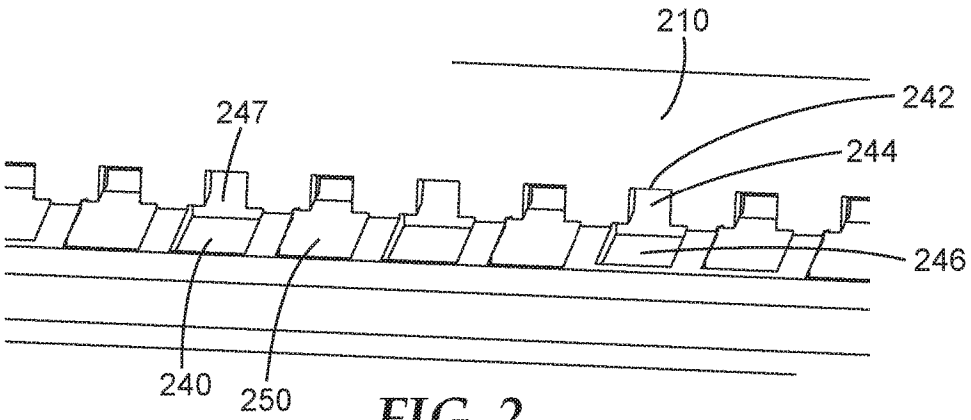
FIG. 2 is a close-up of the view of the connector plug in FIG. 1.

FIG. 2 is a close-up of the view of the connector plug in FIG. 1. FIG. 2 depicts elongated base 210, passageway 240, inverted T-shaped through channel 242 including narrower vertical member 244 and wider bottom member 246, and contact member 250. Several of contact member 250 are missing to better show the shape and size of passageway 240 and inverted T-shaped through channel 242. Passageway 240 may be a recess in one of the tongues extending from elongated base 210; in the illustration of FIG. 2, passageway 240 is slightly shallower than contact member 250 that sits or nestles in the passageway. Nonetheless, passageway 240 may have any suitable dimension and may be configured to either tightly fit contact member 250 (for securing it in place) or loosely fit contact member 250 (for ease of assembly or for flexibility with respect to thermal expansion). Inverted T-shaped through channel 242 includes narrower vertical member 244 and wider bottom member 246. In some embodiments, wider bottom member 246 is aligned with passageway 240 such that the widths of these are the same or both configured to fit the shape and size of contact member 250. Narrower vertical member 244 may be centered above wider bottom member 246 or may be asymmetrically aligned. Narrower vertical member 244 may be any suitable shape and may be substantially a quadrilateral as depicted in FIG. 2 but may also have sloped or curved sides or varying widths or thicknesses. The general shape and size of inverted T-shaped through channel 242 may be designed, along with the shape and size of passageway 240 and the properties of contact member 250 to provide appropriate characteristic impedance. In some embodiments, less material used may provide both lighter weight and greater flexibility to the overall connector plug.

Figure 3:
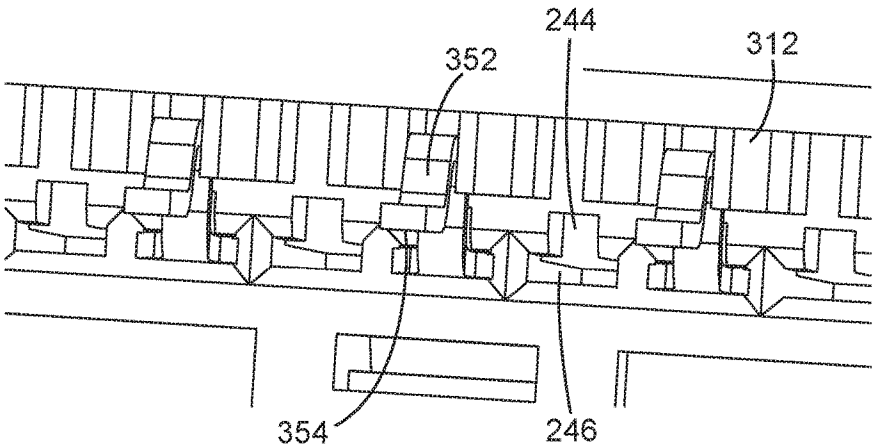
FIG. 3 is a rear perspective view of the connector plug in FIG. 1.

FIG. 3 is a rear perspective view of the connector plug in FIG. 1. Protrusions 312 are disposed on an elongated base and retaining member 352 and mounting member 354 extend rearwardly from the back surface of the base. Besides the contact members illustrated and described in more detail in FIGS. 1 and 2, the contacts include retaining member 352 and mounting member 354. Retaining member 352 extends from the contact member and is secured in a corresponding retaining cavity 247, which includes the passageway and the inverted T-shaped through channel. The retaining member is exposed to the narrower vertical member of the through channel corresponding to the retaining cavity. Mounting member 354 extends from retaining member 352 beyond a back surface of the base for mounting on, for example, a printed circuit board. Protrusions 312 may be chamfered or beveled and may appear between or surrounding certain or all of the contacts. Protrusions 312 may help secure the contacts in place but also may affect the electrical impedance in the overall connector design, and therefore may be leveraged to help attained desired performance characteristics.

Figure 4:
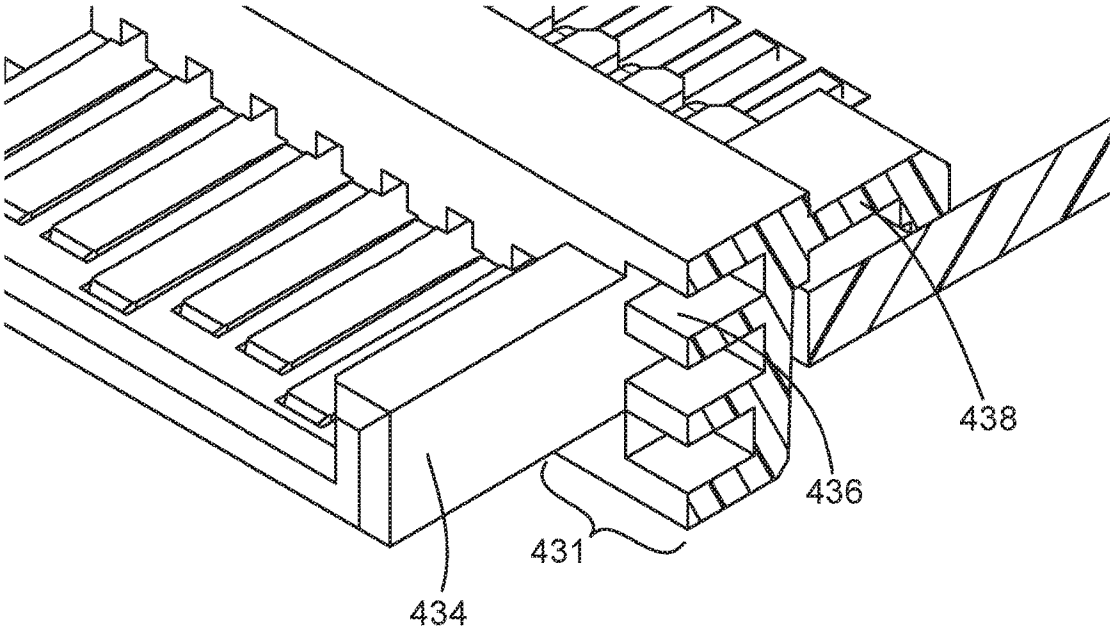
FIG. 4 is a front perspective cross-section of a connector plug.

FIG. 4 is a front perspective cross-section of a connector plug. FIG. 4 illustrates gap 431, side walls 434, rib 436, and L-shaped support 438. As described in conjunction with FIG. 1, rib 436 within gap 431 at least partially defined by side walls 434 and may provide structural reinforcement. Of course, in some embodiments, rib 436 may have other dimensions and may extend for only a portion of gap 431 or beyond the width of gap 431. Additionally shown in FIG. 4 is L-shaped support 438, which in some embodiments provides flexible support for the mounted connector plug on, for example, a printed circuit board, and may help prevent snapping or overflexing the connector plug, which may possible in environments where connecting or disconnecting the connector plug is a frequent occurrence. L-shaped support 438 may have any suitable width and or thickness and may have rounded or squared corners. In some embodiments, the longer arm L-shaped support 438 is not in contact with the substrate that the connector plug is attached to and separated by a shorter arm; in other words, there is an air gap or channel present.

Figure 5:
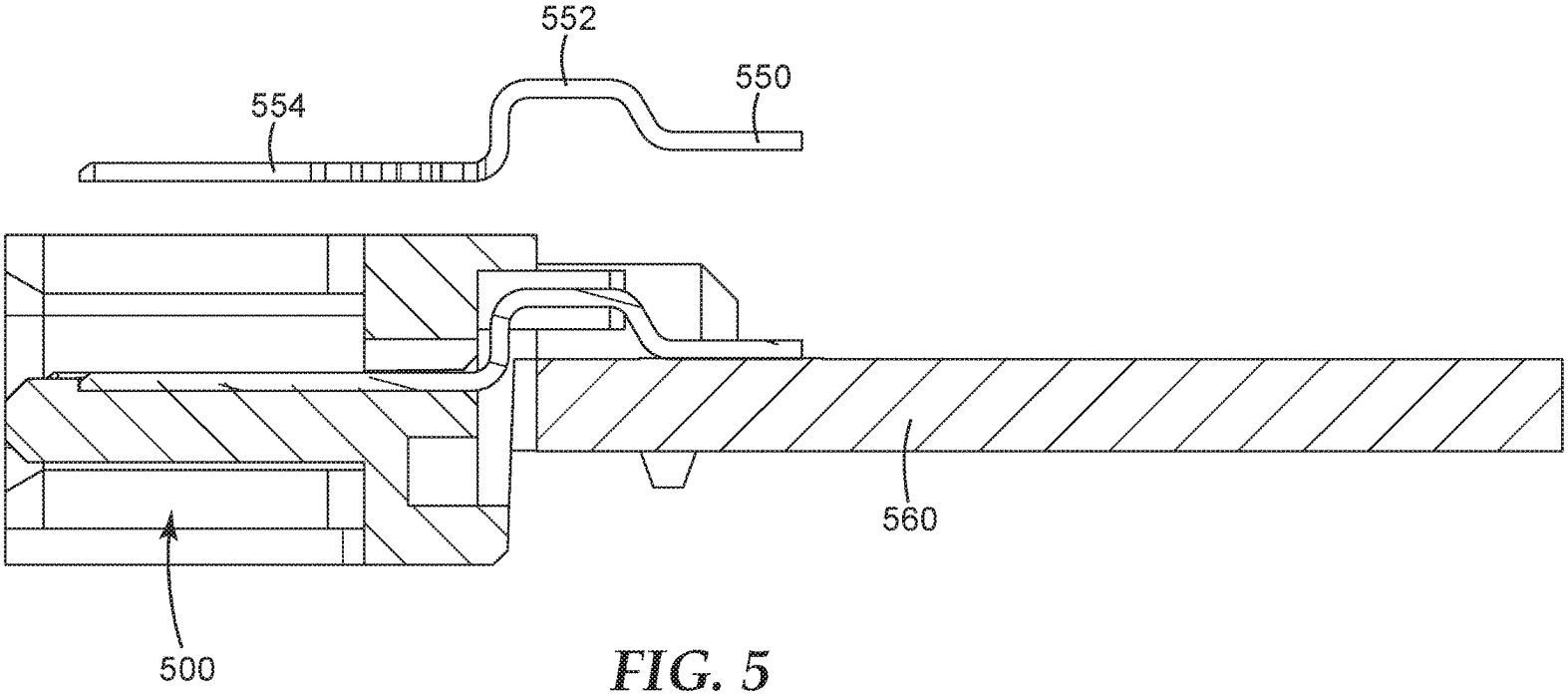
FIG. 5 is a partially-exploded side perspective cross-section of a connector plug.

FIG. 5 is a partially-exploded side perspective cross-section of a connector plug. Connector plug 500 includes conductors including rear member 550, middle member 552, and front member 554, and is mounted on printed circuit board 560. From the view of FIG. 5, it can be seen that the mounting portion of connector plug 500, e.g., the tongue portion is substantially even height with printed circuit board 560. This is due to the shape of the contacts; that is, because front member 554 is below rear member 550. Middle member 552 has a generally inverted U-shape and joins front member 554 with rear member 550. Middle member 552 includes a first leg portion extending upwardly from the front member, a base portion extending from the first leg portion along the mating direction and away (and through in some embodiments) the elongated base, and a second leg portion extending downwardly from the base portion and joining the base portion to the rear member. The vertical distance (projected height) will in some embodiments be larger for the first leg portion than the second leg portion such that the rear member is higher than the front member. Printed circuit board 560 may have one or more contact pads onto which rear member 550 may be attached or held in contact. In some embodiments, rear member 550 is in contact with a conductive wire or other electrical contact.

Figure 6:
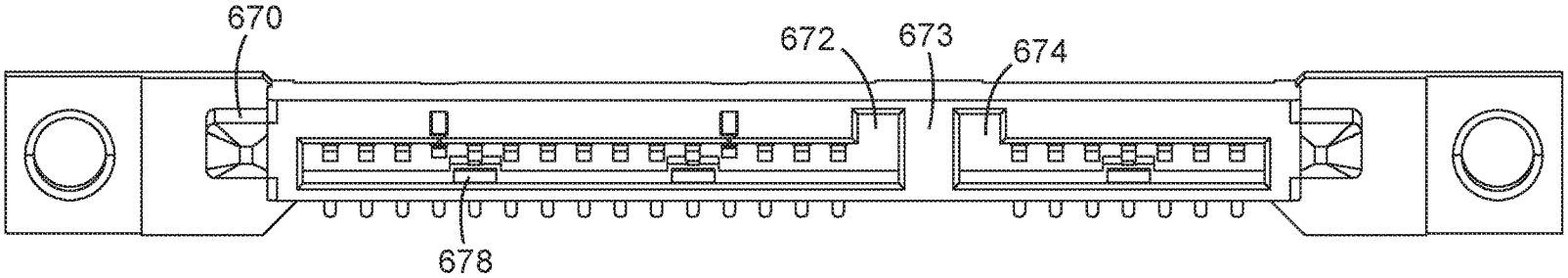
FIG. 6 is a front elevation view of a connector socket.

FIG. 6 is a front elevation view of a connector socket. The connector socket includes unitary housing 670 which includes first L-shaped central slot 672, middle wall 673, second L-shaped central slot 674, and engaging protrusion 678. The connector socket may be configured to accept a particular type of connector plug, such as connector plug 100 in FIG. 1. Each of first L-shaped central slot 672 and second L-shaped central slot 674 may be shaped and sized appropriately to accept a corresponding connector plug. In some embodiments, first L-shaped central slot 672 and second L-shaped central slot 674 are separated by middle wall 673. One or more engaging protrusions 678 may be present to help guide or secure a connector plug into the connector socket. Engaging protrusions 678 may be rounded, slanted, or faceted, and there may be any suitable number having any suitable dimensions or shape. As with the connector plug described elsewhere, the connector socket may be formed by any suitable process from any suitable material, including, for example being injection molded from plastic. Each of the L-shaped central slots have a longer horizontal slot portion and a shorter vertical slot portion. In some embodiments—and in the socket illustrated in FIG. 6—the shorter vertical slot portion is disposed adjacent or proximate to middle wall 673. In other embodiments, the vertical slot portion may be disposed on the side farthest from middle wall 673 or there even may be vertical slot portions disposed in other places. The inclusion of the vertical slot portions in first L-shaped central slot 672 and second L-shaped central slot 674 may help make mating connectors easier, may provide a lighter weight connector socket, and may affect the characteristic impedance of the overall connector.

Figure 7:
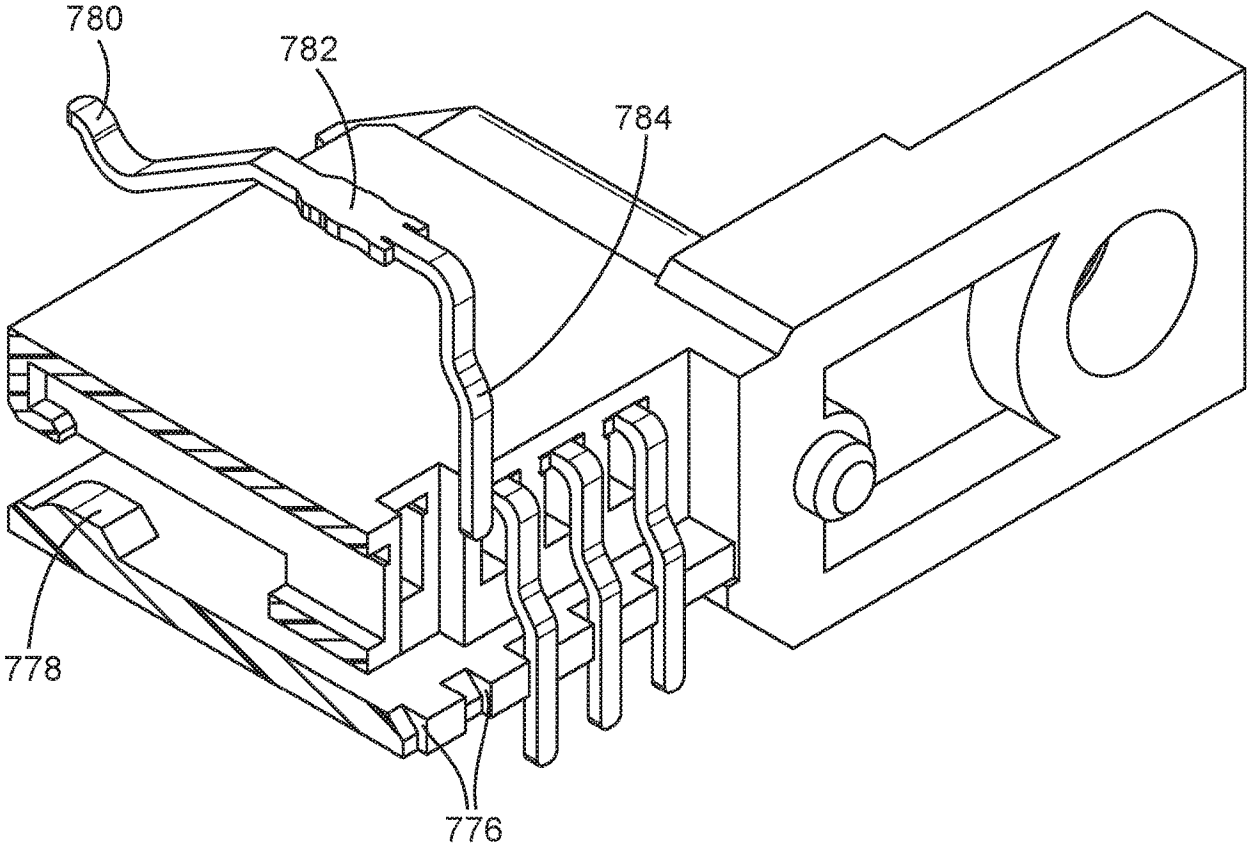
FIG. 7 is a partially exploded rear perspective cross-section of a connector socket.

FIG. 7 is a partially-exploded rear perspective cross-section of a connector socket. FIG. 7 depicts protrusions 776, engaging protrusion 778, contact member 780, retaining member 782, and mounting member 784. Contact member 780, retaining member 782, and mounting member 784 make up each of the contacts shown. Contact member 780 may be flexible, bent, or shaped such that it can easily accept and then remain engaged with the corresponding contact of a connector plug. For example, contact member 780 may be sufficiently flexible to easily accommodate the insertion of a connector plug, in some cases flexing upward to accommodate it. At the same time, contact member 780 may be sufficiently elastic to maintain good electrical contact between the contacts of the connector socket and the contacts of the connector plug. The contact member is at least partially secured in a passageway formed in the top wall of the longer horizontal slot portions of the L-shaped central slots. Retaining member 782 extends from the flexible contact member and is secured in the top wall. In some embodiments, retaining member 782 is substantially flat or planar, allowing it to be firmly secured within the unitary housing of the connector socket. Mounting member 784 extends downwardly from the retaining member along a back surface of the unitary housing and may be mounted onto a printed circuit board; and more specifically, onto a conductive pad or trace on a printed circuit board. Engaging protrusions 778 are shown; as in FIG. 7, one embodiment utilizes a configuration where the engaging protrusion and contact member 780 are shaped to form a very narrow gap between the two parts. Protrusions 776 are formed on the bottom rear side of the unitary housing of the connector socket and, in some embodiments, each mounting member 784 extends between two protrusions. The protrusions may be beveled or chamfered. In some embodiments, protrusions 776 help stabilize and protect from misalignment the mounting members of the contacts. In some embodiments the presence of the protrusions also contributes to the overall electrical impedance of the connector system.

Figure 8:
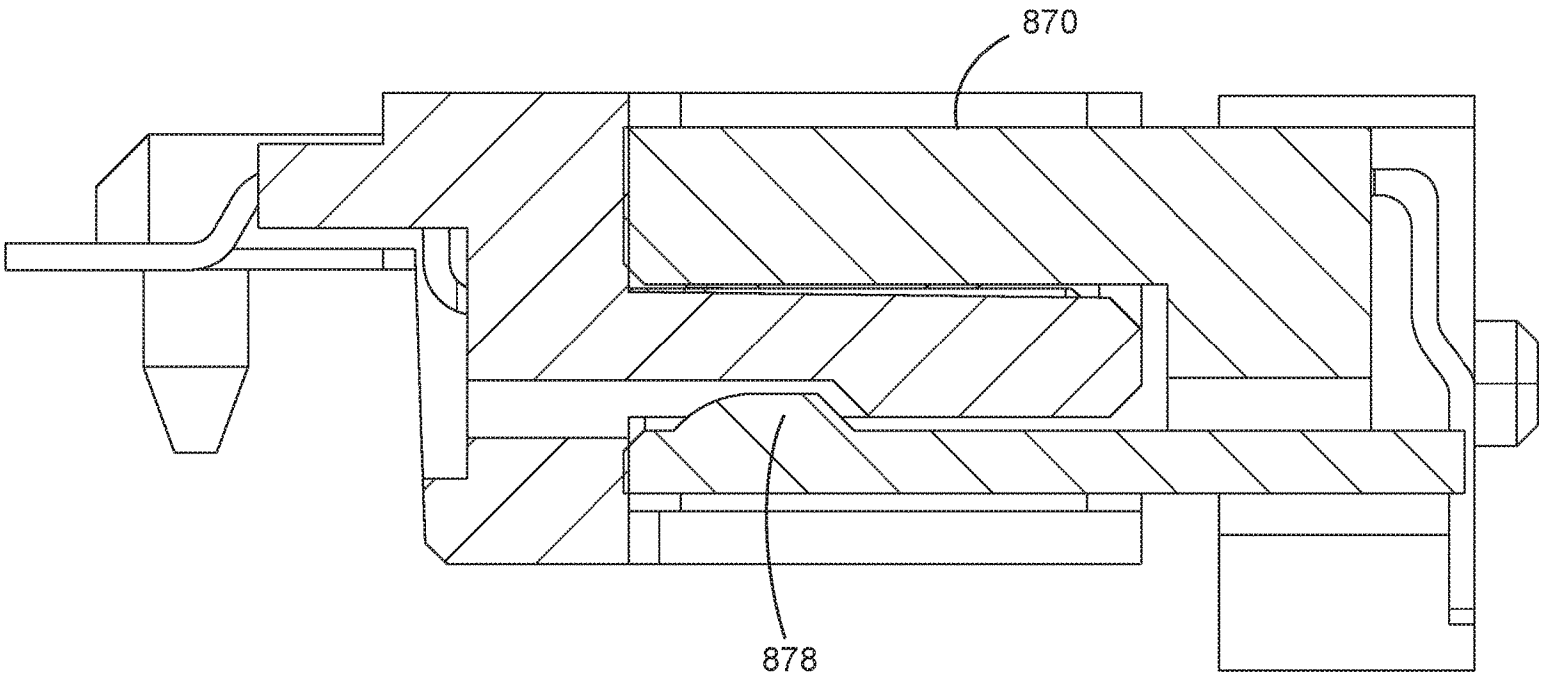
FIG. 8 is a top perspective cross-section of a mated connector plug and socket.

FIG. 8 is a top perspective cross-section of a mated connector plug and socket. Unitary housing 870 of connector socket including engaging protrusion 878 accepts a connector plug such as, for example, the one depicted in FIG. 5. As can be seen in FIG. 8, the bottom of one or more tongues of the connector plug may be shaped or designed to accommodate engaging protrusion 878 after being mated. This may include one or more recesses.

Figure 9:
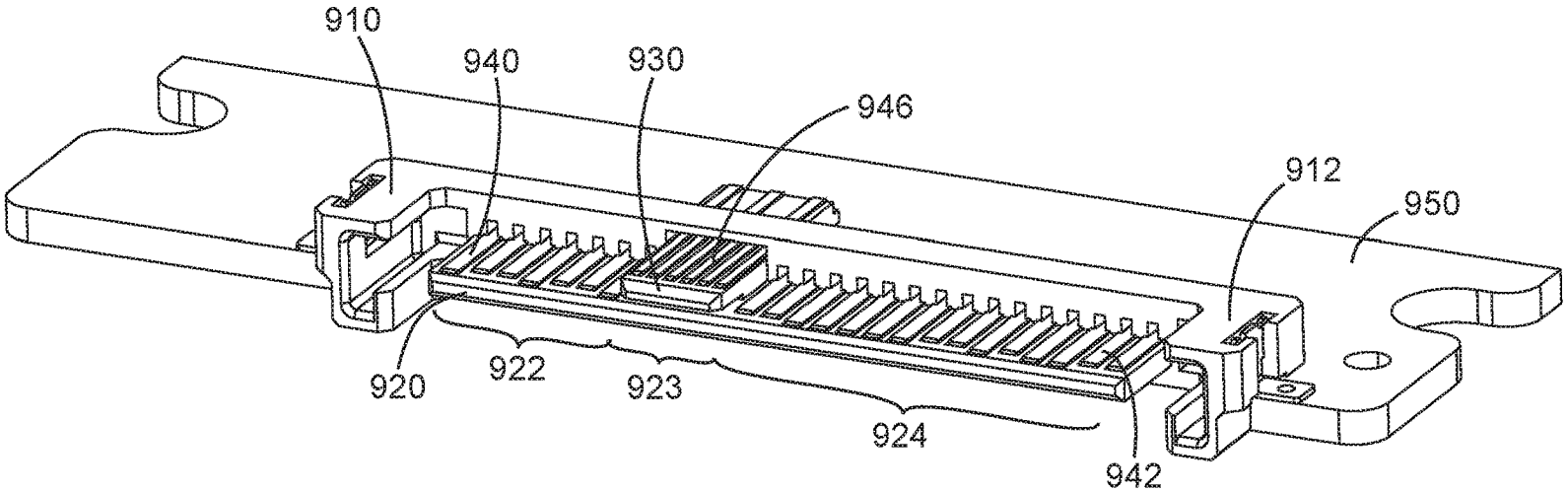
FIG. 9 is a top perspective view of a connector plug.

FIG. 9 is a top perspective view of a connector plug. Elongated base 910 includes end walls 912, bottom tongue 920 includes first bottom tongue portion 922, second bottom tongue portion 924, and third bottom tongue portion 923. First contacts 940 are disposed on first bottom tongue portion 922 and second contacts 942 are disposed on second bottom tongue portion 924. Fourth contacts 946 are disposed on top tongue 930. The connector plug is mounted on printed circuit board 950. In the embodiment shown in FIG. 9, the gap (as, for example, depicted in FIG. 1) is replaced with a top tongue. Top tongue 930 includes fourth contacts 946. First contacts 940, second contacts 942, and fourth contacts 946 may be the same size, shape, and material, or they may be different. The connector plug is mounted on a printed circuit board 950.

Figure 10:
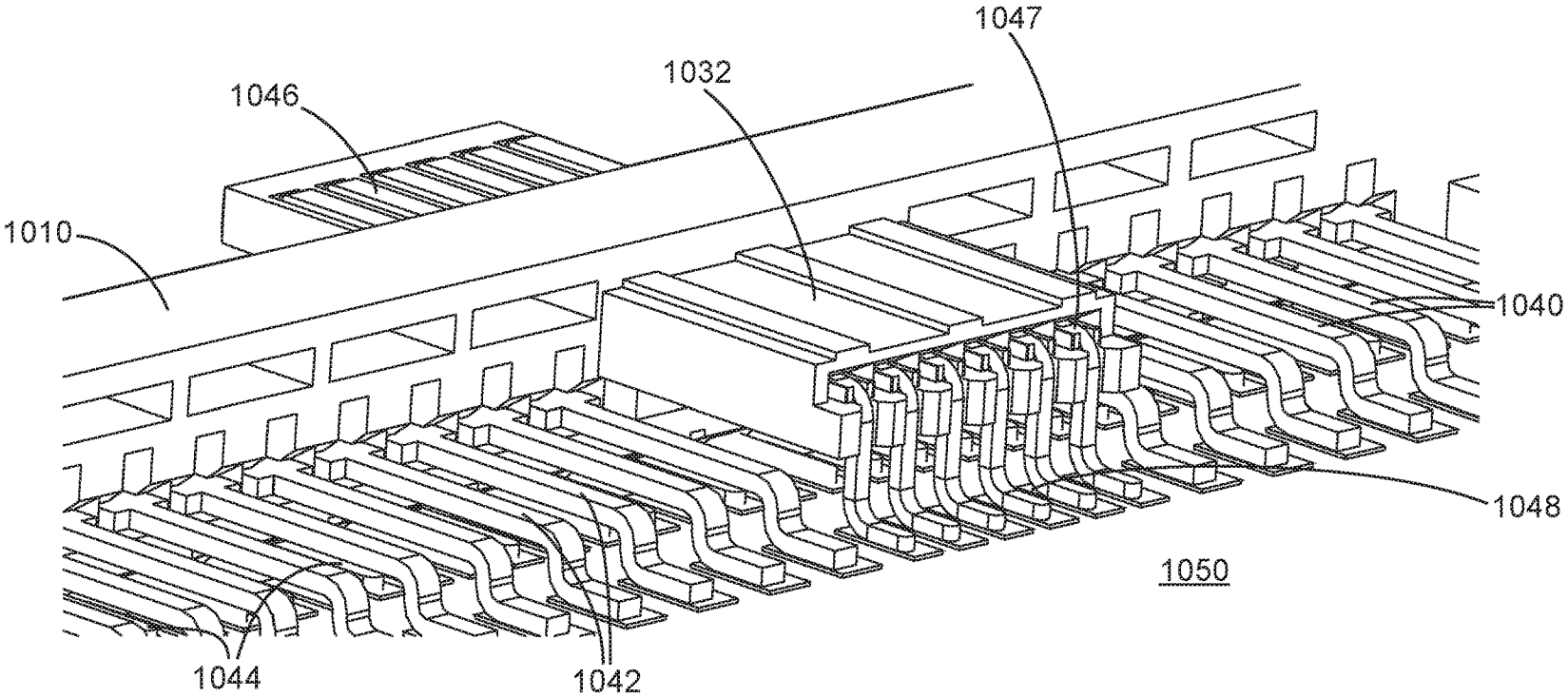
FIG. 10 is a close-up rear perspective view of the connector plug in FIG. 9.

FIG. 10 is a close-up rear perspective view of the connector plug in FIG. 9. From the perspective from FIG. 10, elongated base 1010 is visible on printed circuit board 1050, with first contacts 1040, second contacts 1042, third contacts 1044, and fourth contacts having front member 1046, middle member 1047, and rear member 1048, with a middle member embedded within rear portion 1032 of the top tongue. Third contacts 1044, which were not visible from the perspective of FIG. 9, may run along a bottom surface of one or more of first bottom tongue portion 1020 and second bottom tongue portion 1024 and may make contact with another set of mating contacts on a corresponding connector socket. Front member 1046 of the fourth contacts may be coined or flattened to provide a suitable contact surface for corresponding mating contacts. Front member 1046 is joined to rear member 1048 via middle member 1047. Middle member 1047 is substantially embedded within a rear portion 1032 of the top tongue. In some embodiments, middle member 1047 may be partially embedded within the rear portion of the top tongue. Rear member 1048, which is connected to front member 1046 via middle member 1047, extends from the rear portion of the top tongue and may be mounted onto a printed circuit board. In some embodiments, rear member 1048 extends downwardly from the middle member.

Figure 11:
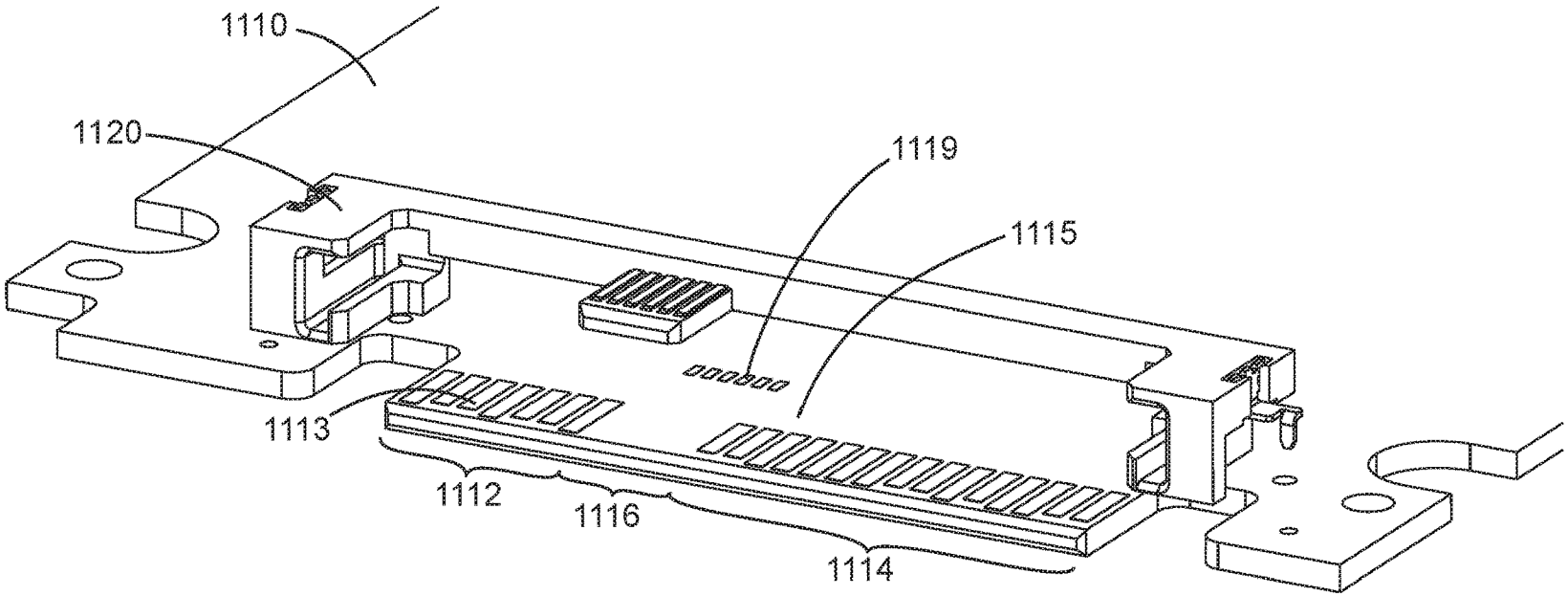
FIG. 11 is an exploded top perspective view of a connector plug.

FIG. 11 is an exploded top perspective view of a connector plug. Printed circuit board 1110 includes first contact pads 1113 within first region 1112, second contact pads 1115 within second region 1114, third region 1116 between, and third contact pads 1119 within fourth region 1118. Elongated base 1120 is shown partially separated from printed circuit board 1110 in order to more effectively illustrate each of the contact pads and regions. As for the other embodiments described herein, the relative sizes and shapes for first region 1112, second region 1114, and third region 1116 may depend on the desired connector application. In this embodiment, first contact pads 1113 and second contact pads 1115 may act as substitutes for separate conductors; instead allowing conductive traces on the printed circuit board (not shown) to suitably transport electrical signals. In some embodiments, the absence of separate conductors allows for a lighter, thinner connector plug that may be more straightforward to manufacture. Moreover, the configuration shown in FIG. 11 may enable different electrical impedance values for the connector, allowing for more overall design flexibility.

Figure 12:
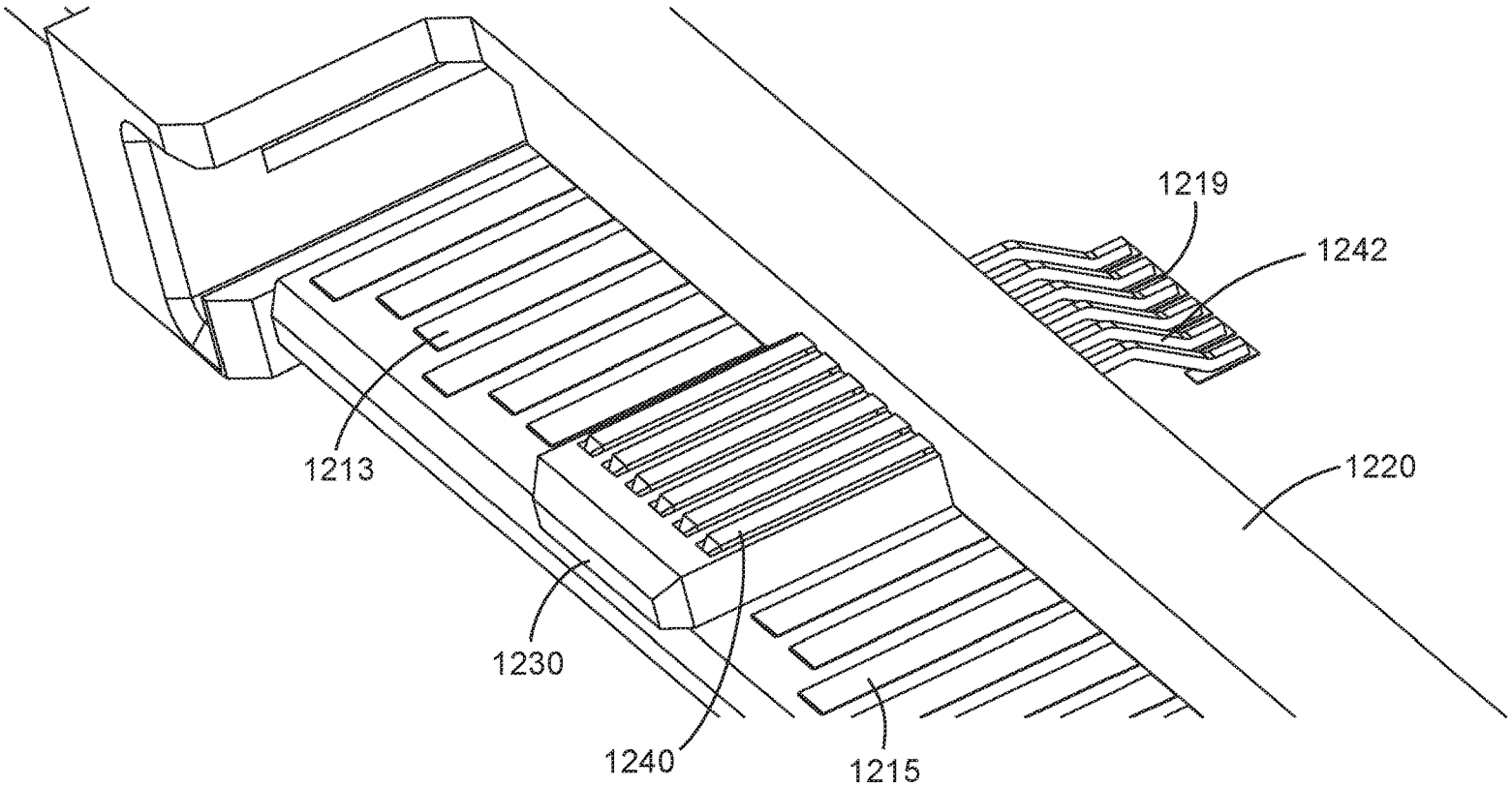
FIG. 12 is a top perspective view of a connector plug.

FIG. 12 is a top perspective view of a connector plug. FIG. 12 shows first contact pads 1213, second contact pads 1215, and third contact pads 1219. Elongated base 1220 includes top mating tongue 1230 which includes contacts including front member 1240 and rear member 1242. In some embodiments, top mating tongue 1230 is positioned in the third region, between the first and second regions. In some embodiments, top mating tongue 1230 may include contacts with front member 1240 and rear member 1242. In some embodiments, at least part of front member 1240 or rear member 1242 is at least partially embedded in elongated base 1220. In some embodiments, rear member 1242 is disposed on or configured to make contact with third contact pads 1219. As in the other embodiments described herein, any suitable shape, size, and material for the contacts may be used. In some embodiments, the connector plug shown herein further includes a front portion or a rear portion that at extends forwardly or rearwardly, respectively, from elongated base 1220 and may at least partially embed either of front member 1240 or rear member 1242.

Figure 13:
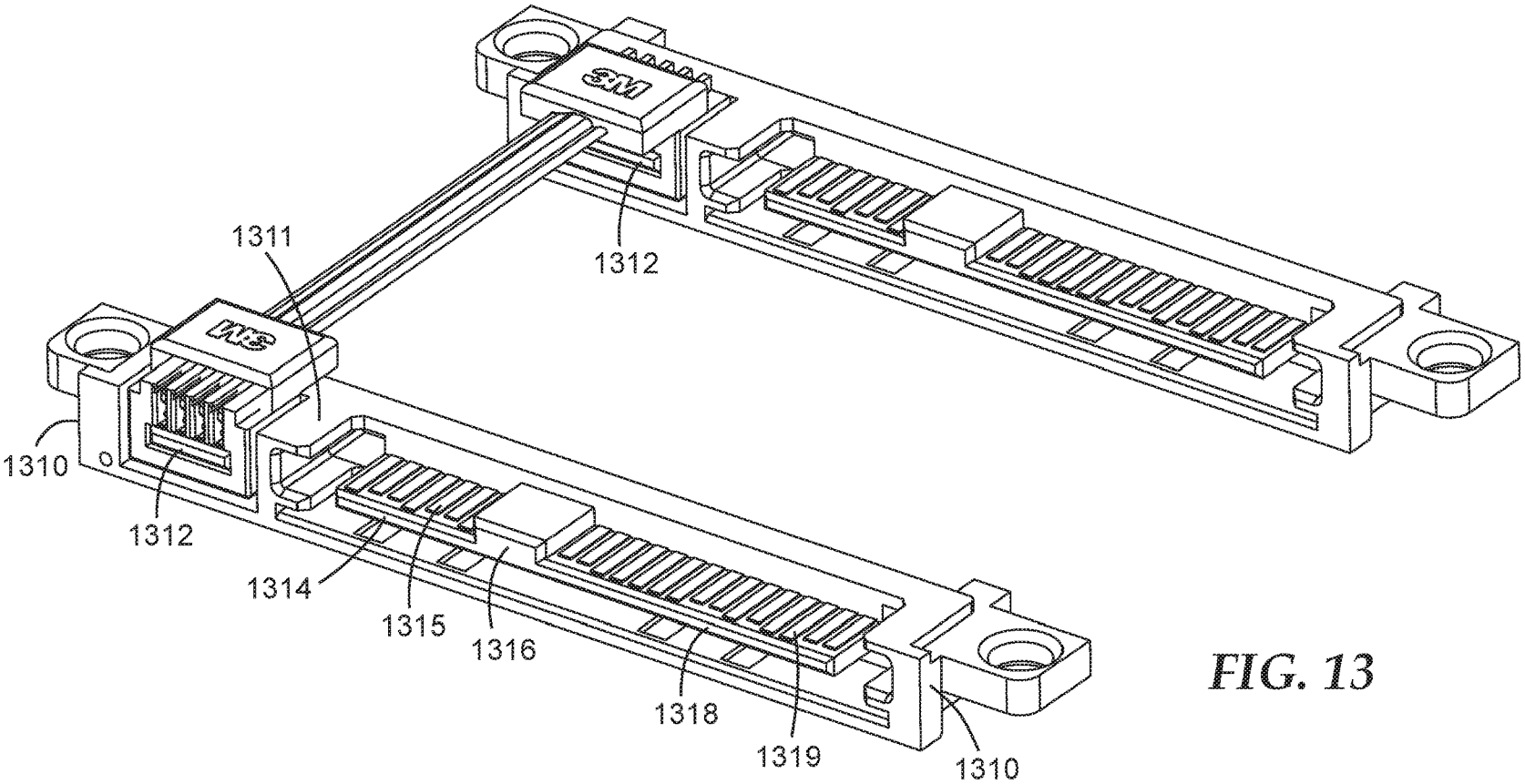
FIG. 13 is a top perspective view of two connector plugs.

FIG. 13 is a top perspective view of two connector plugs. Each connector plug includes end walls 1310, middle wall 1311, first tongue 1312, first tongue portion 1314 of second tongue with second passageways 1315, second tongue portion 1318 of second tongue with third passageways 1319, and third tongue portion 1316. In FIG. 13, two similarly oriented connector plugs are depicted so that both a forward and rear view of certain components may be presented within the same figure. Middle wall 1311 separates first tongue extending forwardly along the mating direction from first tongue portion 1314 of the second tongue having second passageways 1315, where, for example, conductors or contact pads would be nestled. Second passageways 1315 (as well as third passageways 1319) may extend through a space in the base of the connector plug, and may include or intersect, for example, inverted T-shaped through channels as described herein for other connector plugs. First portion 1314 of second tongue and second portion 1318 of second tongue are separated by a third tongue portion 1316. In some embodiments, third tongue portion 1316 is thicker than the first and second tongue portions of the second tongue. In some embodiments, third tongue portion 1316 has no contacts (nor in some embodiments, even passageways in which contact pads may rest).

Figure 14:
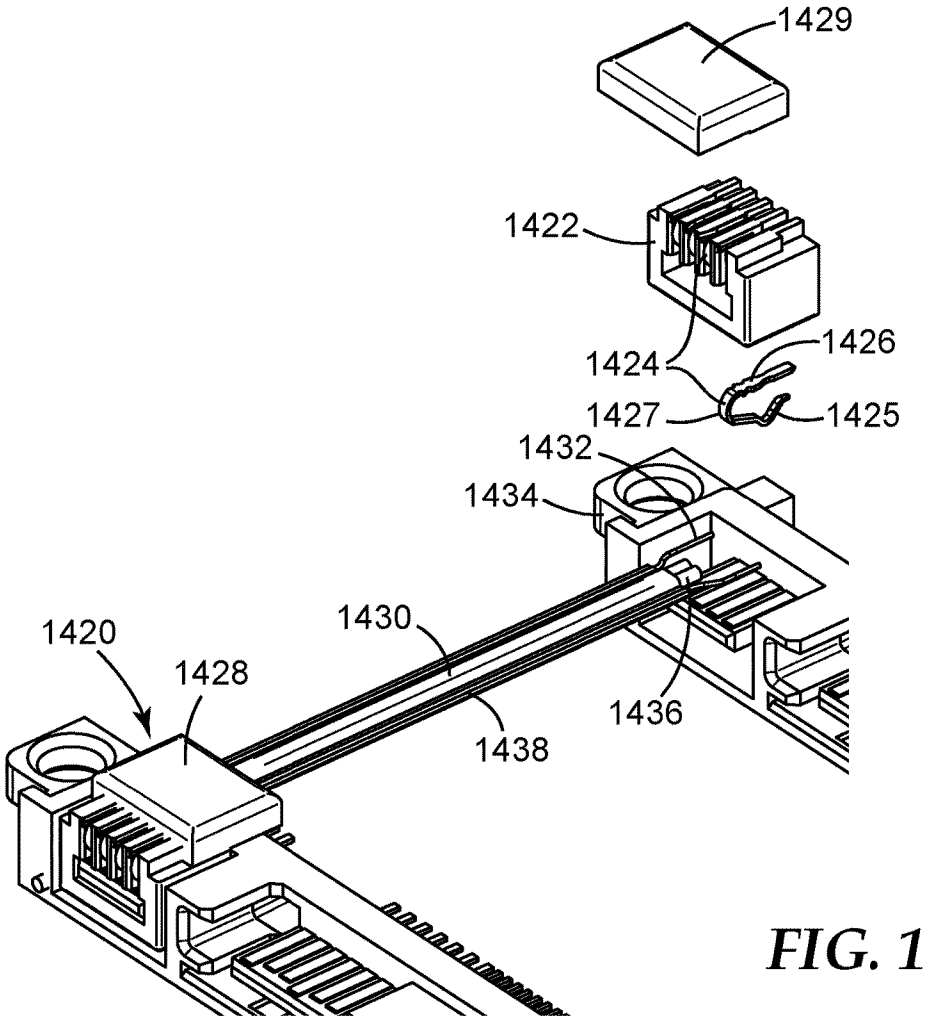
FIG. 14 is a partially exploded top perspective view of two connector plugs.

FIG. 14 is a partially exploded top perspective view of two connector plugs. Cable assembly 1420 includes housing 1422, overmold 1428, and fourth contacts 1424 including first leg portion 1425, second leg portion 1426, and base portion 1427. Cable 1430 includes conductor 1432, drain wire 1434, insulator 1436, and jacket 1438. Cable assembly 1420 surround the first tongue and includes housing 1422. Housing 1422 may be formed from any suitable material and is shaped to accommodate the first tongue and appropriate conductive contacts. As for other parts described herein, housing 1422 may be formed through any suitable process including through injection molding. Fourth contacts 1424 are generally U-shaped and include a first leg portion 1425 and adapted to contact a corresponding first contact spaced apart and on the top of the first tongue (element 1312 in FIG. 13, for example). Second leg portion 1426 of fourth contacts 1424 extends horizontally and is above first leg portion 1425 and may be adapted to contact conductive wires of a cable, described in more detail below. Fourth contacts 1424 also include base portion 1427 that join the first and second leg portions. Base portion 1427 may be curved, partially curved, or faceted. In some embodiments the locally lowest portion or point of first leg portion 1425 may be nearest an end distal the base portion, may be nearest an end proximate the base portion, or may be substantially centered between these two ends; for example, within the center third of first leg portion 1425. From another perspective, the lowest portion of first leg portion 1425 may be located at a point along the extent in the mating direction of first leg portion 1425. Lowest is used relatively here based on the perspective of FIG. 14, and may, from a different perspective, be identified as either the highest, leftmost, or rightmost portion, adjusted as appropriate.

Cable 1430 includes conductors 1432 and drain wire 1434, insulation 1436, and jacket 1438. In some embodiments, cable 1430 may be a flat or substantially flat ribbon cable. Conductors 1432 can include or be formed from any suitable electrically conductive material, and may be selected for its electrical or physical properties, for example, conductivity, coefficient of thermal expansion, malleability, or ductility. Suitable materials include copper, aluminum, and silver. Drain wire 1434 may have similar characteristics or be formed from a similar material as conductors 1432, or it may have different dimensions or composition. Insulation 1436 can include any suitable dielectric material for insulating conductor 1432 and may be selected for flexibility, melting point, dielectric constant, or any other physical or electrical property or properties. Suitable materials include polyethylene, polyethylene foam, or polytetrafluoroethylene. The materials for both conductors 1432 and insulation 1436 may be selected to give an overall nominal characteristic impedance within a desired range. Drain wire 1434 may be uninsulated. In some embodiments, the front portions or ends of conductors 1432 or drain wire 1434 may be coined or plated (for example, with gold) to improve contact or conductivity. Conductors and drain wires may be any suitable wire gauge.

Jacket 1438 may be any suitable material to impart desirable external properties on cable 1430, such as abrasion or fire-resistance. In some embodiments, a flexible material may be selected to preserve desired physical properties of cable 1430. Jacket 1438 may also be thick to prevent damage or wear to the internal conductors 1432 associated with use. In some embodiments, jacket 1438 may also include one or more conductive layers along the interior perimeter of jacket 1438, such as a braided copper layer or silver plating. Conductive layers may help prevent electromagnetic fields within the cable from radiating into the external environment or from interfering with nearby electronic components, and may prevent external electromagnetic fields from interfering with the conductors and drain wires in the cable. In some embodiments, jacket 1438 may be formed from a polymeric material.

Overmold 1428 may be attached to or disposed on a top surface of housing 1422 and may encapsulate at least the contact points between wires (conductors 1432 and drain wires 1434) and the fourth contacts 1424 (more specifically at second leg portion 1426). Overmold 1428 may either be a separately and later formed injection molded part, is overmold 1428 may be cured in place after the contact between fourth contacts 1424 and conductors 1432 is made. In some embodiments, overmold 1428 may be configured to be nonremovable. In some embodiments, overmold 1428 may snap or press into place and be removable. Overmold 1428 may be designed to prevent cable 1430 from disconnecting from cable assembly 1420. Overmold 1428 may be made from any suitable material, including thermoplastic and UV curable polymers. In some embodiments, overmold 1428 may cover substantially all of the top surface of cable assembly 1420. Note that per FIG. 14, the conductive wires may be attached to fourth contacts 1424 such that cable 1430 extends either forwardly or rearwardly from the rest of the connector assembly.

Figure 15:
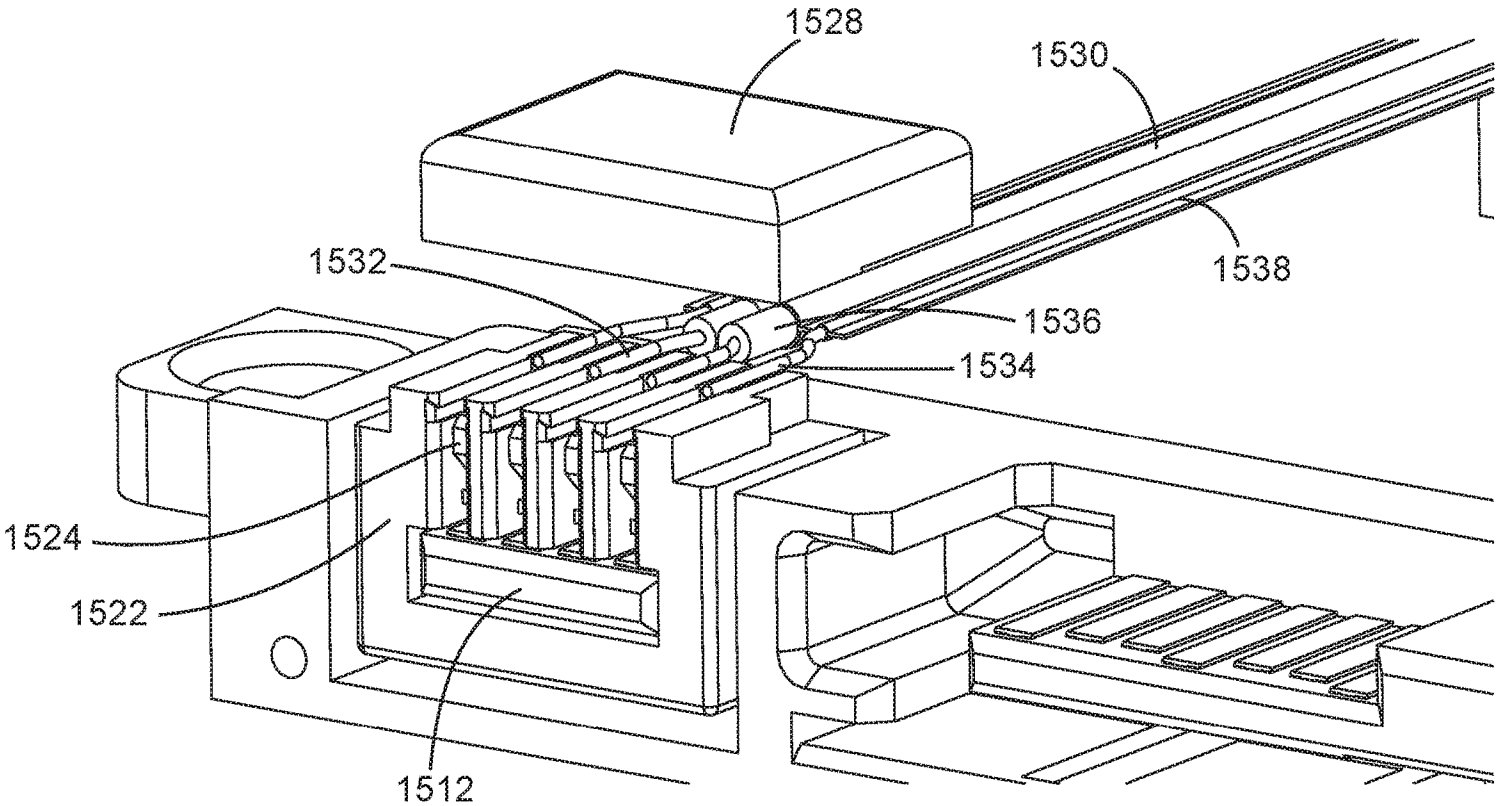
FIG. 15 is a partially exploded close-up of the connector plug of FIG. 13.

FIG. 15 is a partially exploded close-up top of a connector plug of FIG. 13. In more detail, FIG. 15 depicts first tongue 1512, housing 1522, fourth contacts 1524, and overmold 1528, as well as conductor 1532, drain wire 1534, insulator 1536, and jacket 1538 of cable 1530. Jacket 1538 is shows as at least partially cut away to better illustrate the difference between the insulated conductors 1532 and the uninsulated drain wires 1534. Of course, the particular configuration and function of the wires within cable 1530 depend on the application and desired signal traveling through the cable. There need not be insulated conductors at all, for example, or there need not be drain wires. In some embodiments, uninsulated conductors are used, but as signal carrying conductors and not as drain wires. Any suitable number and configuration of the wires of cable 1530, whether or not insulated, are contemplated for the cable. Of course, correspondingly, the number of fourth contacts 1524 and the overall width and spacing of first tongue 1512 may have to be adjusted accordingly.

Descriptions for elements in figures should be understood to apply equally to corresponding elements in other figures, unless indicated otherwise. The present invention should not be considered limited to the particular embodiments described above, as such embodiments are described in detail in order to facilitate explanation of various aspects of the invention. Rather, the present invention should be understood to cover all aspects of the invention, including various modifications, equivalent processes, and alternative devices falling within the scope of the invention as defined by the appended claims and their equivalents.

What is claimed is:

1. An elongated electrical connector for mounting on a printed circuit board and mating with a mating connector along a mating direction, the connector comprising:

an elongated base extending along a longitudinal direction perpendicular to the mating direction;

first and second end walls extending forwardly along the mating direction from opposite longitudinal ends of the base;

coplanar first and second tongues extending forwardly along the mating direction from the base and defining a gap therebetween;

a plurality of spaced apart parallel passageways on a top surface of the first and second tongues oriented along the mating direction, each passageway extending through the base;

a plurality of spaced apart inverted T-shaped through channels defined in the base, each inverted T-shaped through channel comprising a wider bottom member aligned with a corresponding passageway and a narrower vertical member extending upwardly from the wider bottom member along a vertical direction perpendicular to the mating and longitudinal directions, the bottom member and the passageway, in combination, defining a retaining cavity in the base;

a plurality of contacts, each contact comprising:

a contact member disposed in a corresponding passageway for making contact with a corresponding contact of a mating connector;

a retaining member extending from the contact member and secured in a corresponding retaining cavity, the retaining member being exposed to the narrower vertical member of the through channel corresponding to the retaining cavity; and a mounting member extending from the retaining member beyond a back surface of the base for mounting on a printed circuit board.

2. The electrical connector of claim 1, wherein each of the first and second tongues has a side wall separating the tongue from the gap.

3. The electrical connector of claim 1, wherein the elongated base and each of the first and second end walls define an opening between the base and the end wall extending from a front surface to a back surface of the base.

* * * * *